United States Patent [19]

Meserol

[11] Patent Number: 4,752,971

[45] Date of Patent: Jun. 28, 1988

[54] MULTI-PURPOSE, REVERSIBLE, BLANKET-GARMENT

[76] Inventor: Shirley A. Meserol, 12 Stoneybrook Rd., Montville, N.J. 07045

[21] Appl. No.: 60,504

[22] Filed: Jun. 11, 1987

[51] Int. Cl.[4] ..... A41D 3/08

[52] U.S. Cl. ..... 2/88; 2/84

[58] Field of Search ..... 2/88, 84, 85, 87, 93, 2/94, 69

[56] References Cited

U.S. PATENT DOCUMENTS

| | | | |
|---|---|---|---|
| 1,839,003 | 12/1931 | Steinberg | 2/88 |
| 1,901,223 | 3/1933 | Bush | 2/88 |
| 2,408,662 | 10/1946 | Levitt | 2/84 |
| 2,462,269 | 2/1949 | Krempel | 2/84 |
| 2,870,464 | 1/1959 | Lalick | 2/84 X |
| 2,971,198 | 2/1961 | Tomich | 2/88 X |
| 3,522,612 | 8/1970 | Palmer | 2/84 X |
| 4,078,264 | 3/1978 | DeGennaro et al. | 2/88 |
| 4,258,439 | 3/1981 | York | 2/88 X |
| 4,370,755 | 2/1983 | Crumby | 2/88 |

*Primary Examiner*—Louis K. Rimrodt
*Assistant Examiner*—J. L. Olds
*Attorney, Agent, or Firm*—R. Gale Rhodes, Jr.

[57] ABSTRACT

Multi-purpose, reversible, blanket garment including a main member of a size and configuration for use as an automobile robe, blanket, and a poncho-type garment, and which is formed of at least two opposed layers, one layer being a layer of woven, wool, blanket-type material, and the other layer being a layer of water repellent material, and which includes a hood of the same two layers of materials and wherein the hood may be fastened and unfastened from the main member by mating zippers provided on the hood and main member. The multi-purpose garment may further include epaulets for enhanced visual appearance, for securing various objects to the poncho-type garment and one of which may be used as an over-the-shoulder carrying strap for carrying the main member and hood upon the main member being suitably folded for carrying.

6 Claims, 9 Drawing Sheets

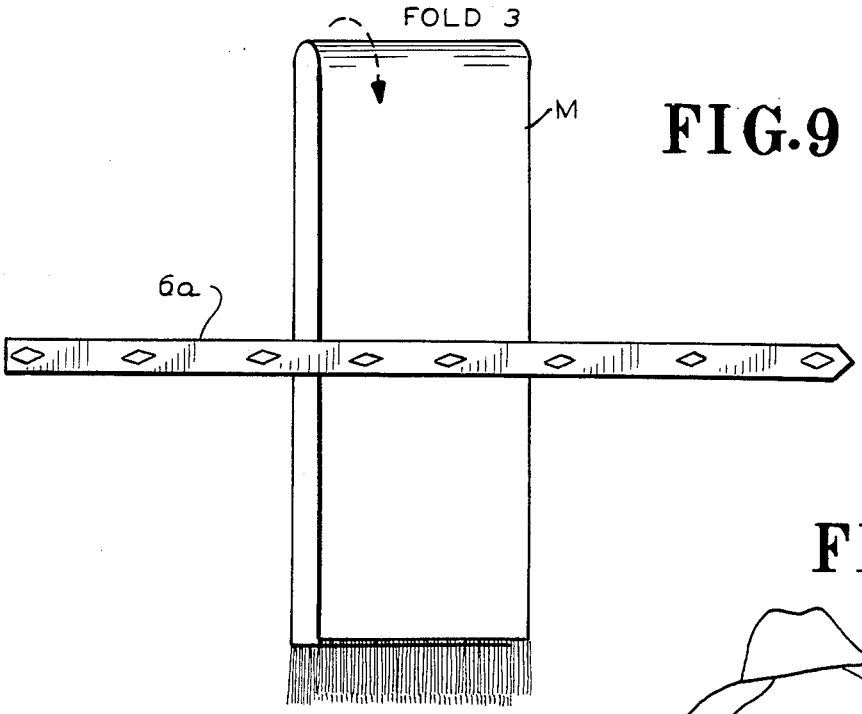
FIG. 9
FIG. 11
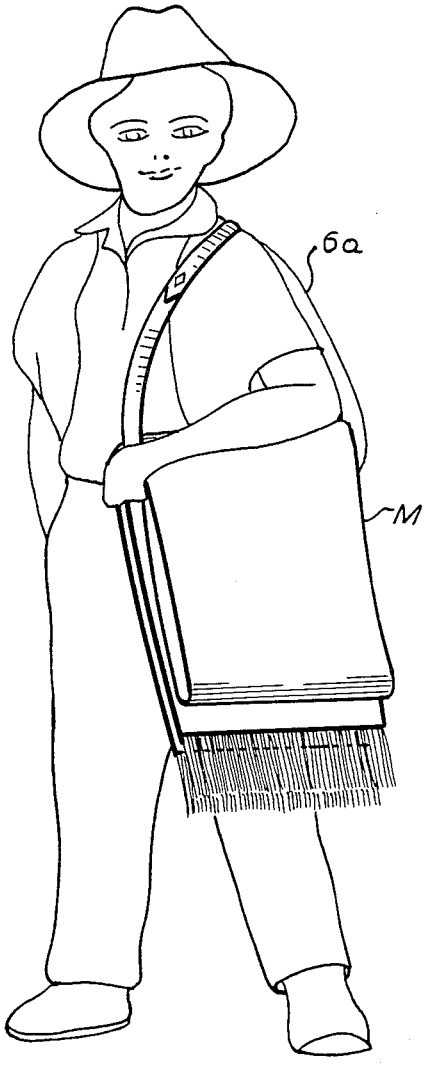
FIG. 10
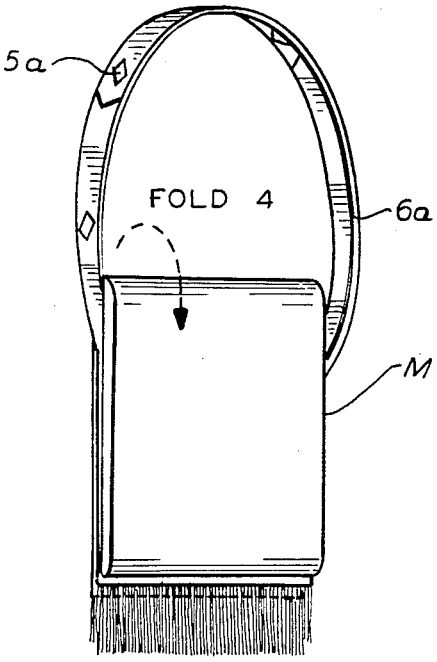

MULTI-PURPOSE, REVERSIBLE, BLANKET-GARMENT

BACKGROUND OF THE INVENTION

An increasing number of people appear to be spending more and more of their time in participating in outdoor activities and spending more and more of their weekends and vacation time engaged in outdoor sports and recreation. This, coupled with the fact that many geographical regions of the United States have cold and wet weather during a substantial portion of the year, has given rise to an increased demand for a multi-purpose garment which is durable, of high quality, warm, substantially waterproof, which may be worn by a person as a poncho-type garment, which is easily folded and conveniently carried by a person, and which otherwise fills a number of outdoor needs such as a picnic blanket, a tailgate cover for tailgate parties, and an automobile robe or seat cover.

Various types of ponchos and other outer rain and cold protective garments which may or may not be convertible into blankets, automobile robes, and the like, are known to the prior art. These prior art garments include those disclosed in U.S. Pat. Nos. 1,839,003; 1,901,223; 2,408,662; 2,462,269; 2,513,074; 2,870,464; 2,971,198; 3,522,612; 4,258,439; and 4,370,755. However, these prior art garments, many of which are multi-purpose garments, all suffer from one or more of the following disadvantages: they are not of the high quality desired by many people today, are not sufficiently durable and handsome in appearance as presently desired by many people, do not include mating zippers for conveniently and securely fastening a hood to a blanket-type member to form a poncho-type garment, do not include epaulets for enhanced appearance and which may serve as a handy means for securing items such as binoculars, cameras, etc. to a garment and which may also serve as an over-the-shoulder carrying strap for a multi-purpose garment, and do not permit a multi-purpose garment to be used as an automobile robe or a cover for the back seat of an automobile while also permitting use of the back seat seat belts.

Accordingly, it is the primary object of the present invention to provide a novel, multi-purpose, reversible blanket-garment which is primarily useful as a poncho-type garment against inclement conditions of weather such as cold, rain and snow, and which may be readily converted to fulfill the above-noted needs of today's increased outdoor and recreational activities.

SUMMARY OF THE INVENTION

The present invention satisfies the foregoing object and includes a main member of a size and configuration for use as an automobile robe, blanket, and a poncho-type garment, and which is formed of at least two opposed layers, one layer being a layer of woven, wool, blanket-type material, and the other layer being a layer of water repellent material, and which includes a hood of the same two layers of materials and wherein the hood may be fastened and unfastened from the main member by mating zippers provided on the hood and main member. The multi-purpose garment of the present invention may further include epaulets for enhanced visual appearance, for securing various objects to the poncho-type garment and one of which may be used as an over-the-shoulder carrying strap for carrying the main member and hood upon the main member being suitably folded for carrying.

DESCRIPTION OF THE FIGURES

FIG. 9 is a further diagrammatical illustration showing the further folding of the main member over an epaulet or carrying strap;

FIG. 10 is a view, in perspective, showing the folded main member extending through and supported by an epaulet serving as an over-the-shoulder strap; and FIG. 11 is a diagrammatical illustration of a person carrying the folded main member of the present invention by use of an epaulet serving as an over-the-shoulder carrying strap.

DESCRIPTION OF THE PREFERRED EMBODIMENT

Figure 1:
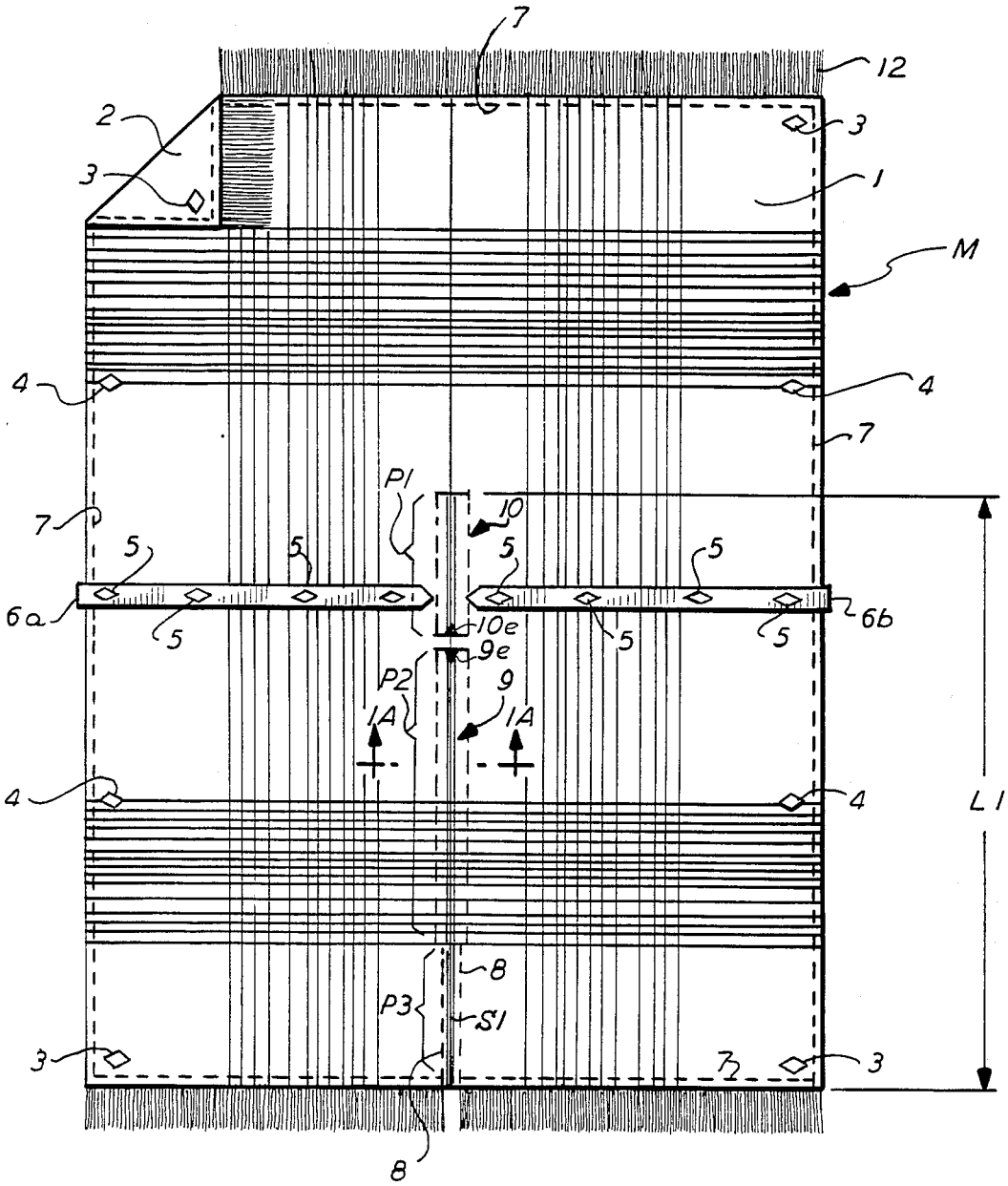
FIG. 1 is primarily a top view of the top layer of material of a main member embodying the present invention and which shows the upper lefthand corner folded over to show a portion of the bottom layer of material; also shown are upper and lower zippers and the top portions of epaulets.
Figure 2:
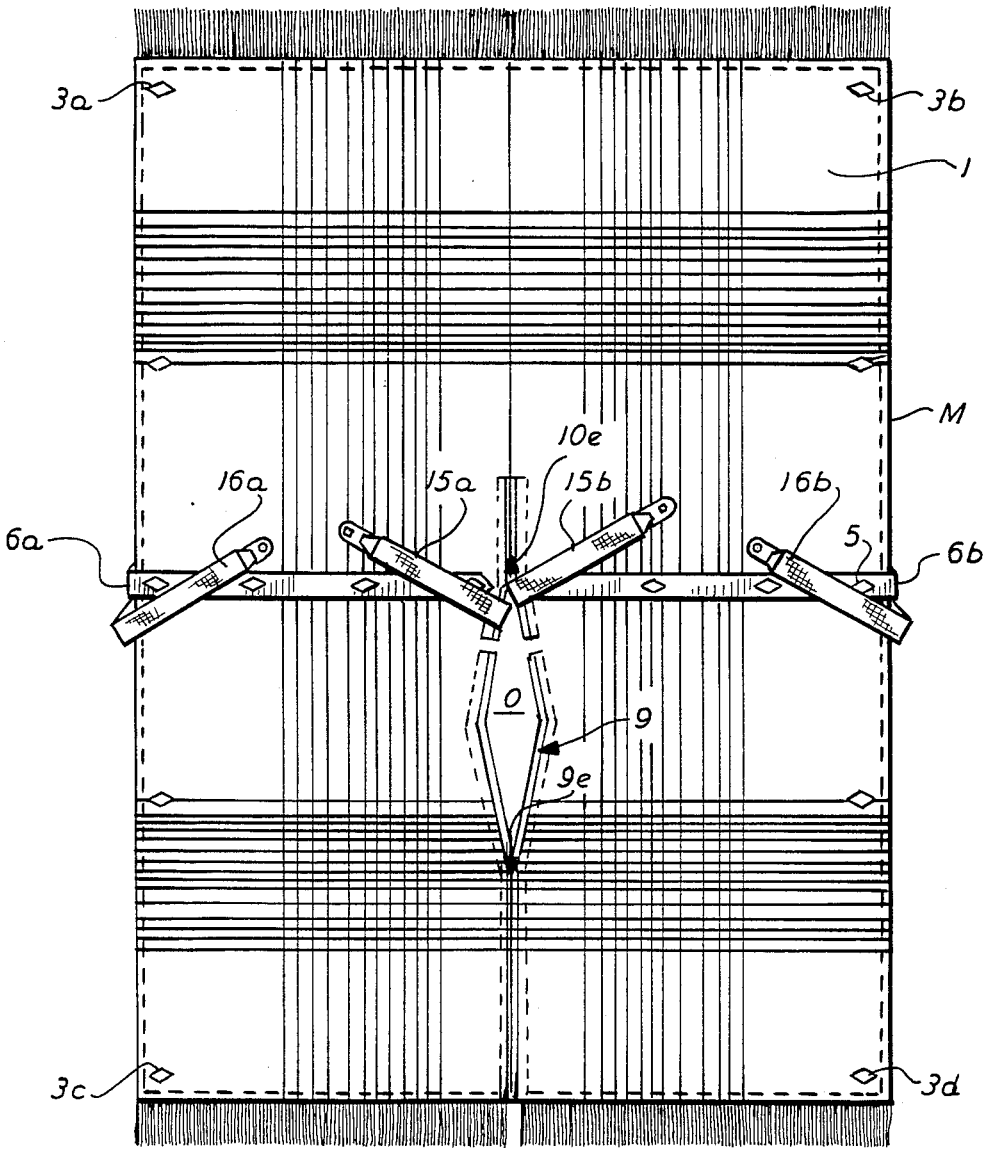
FIG. 2 is a top view of the main member of the present invention shown employed as an automobile robe or the back seat cover of an automobile and shown permitting use of the back seat seat belts.
Figure 3:
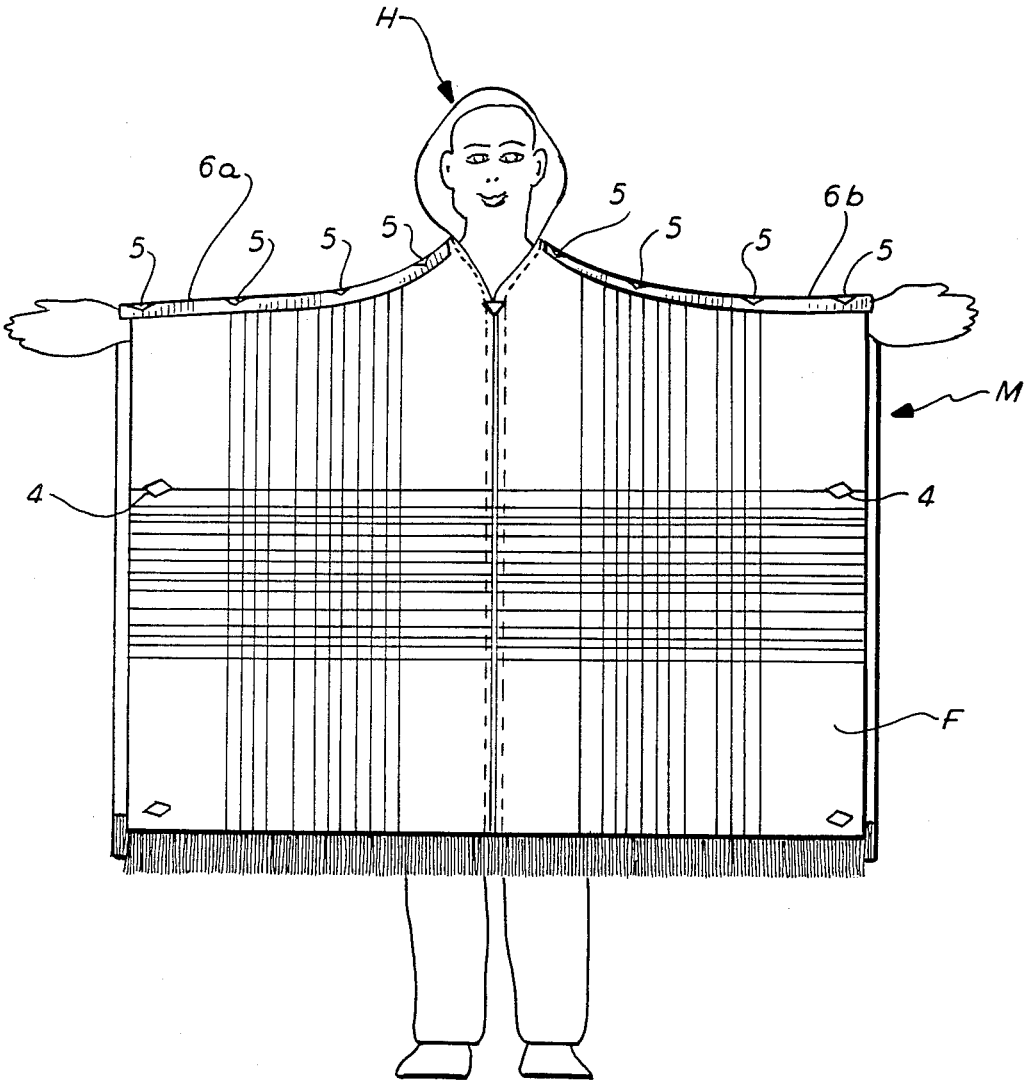
FIG. 3 is an illustration of the multi-purpose garment of the present invention including a main member and hood, and shows the multi-purpose reversible, blanket-garment embodied as a poncho-type garment.
Figure 4:
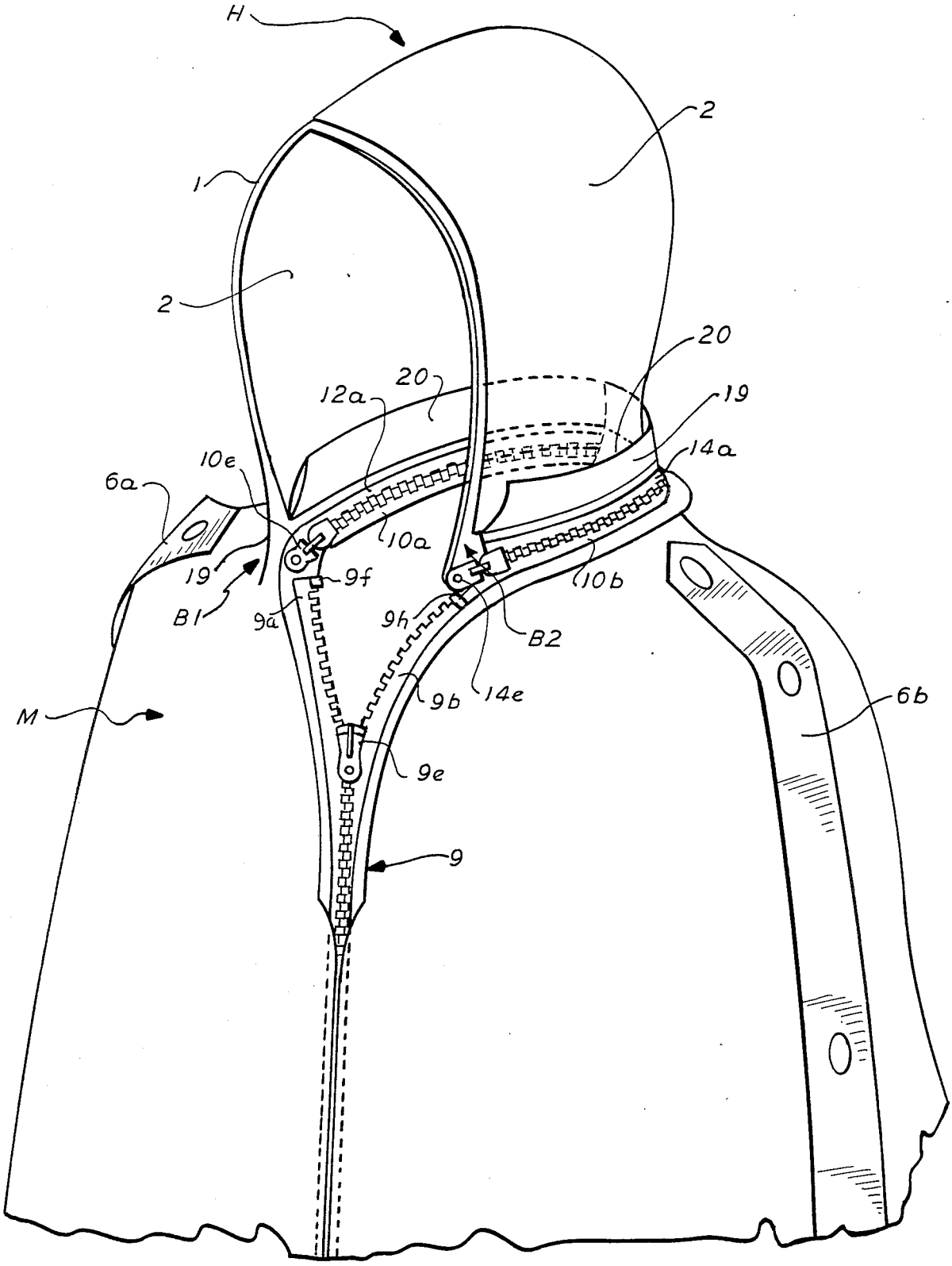
FIG. 4 is a diagrammatical view, in perspective, illustrating the preferred manner of fastening together the hood and main member by mating zippers.

Referring first to FIGS. 1 and 2, it will be understood that the multi-purpose, reversible, blanket-garment of the present invention may include a main member M (FIG. 1) and a hood H (FIG. 4) which may be novelly secured together by mating zippers as illustrated in FIG. 4 and described in detail hereinafter. Further, it will be understood that the blanket-garment of the present invention may further include a pair of epaulets 6a and 6b shown in various of the FIGS. but which may be seen conveniently in FIGS. 6 and 6A. Generally, it will be understood, inter alia, that upon the hood H being secured to the main member M as illustrated in FIG. 4 by the mating zippers shown and described in detail below, the blanket-garment of the present invention may function as a poncho-type garment for wear by a person as may be better understood by reference to FIG. 3. The epaulets 6a and 6b (FIG. 1) may be fastened to the main member M by suitable fastening means described below to enhance the appearance of the blanket-garment and to provide a means for securing various items to the multi-purpose garment when serving as a poncho-type garment such as binoculars, camera, etc. In addition, one of the epaulets, e.g. epaulet 6b of FIG. 6, may be utilized to secure the hood H to the main member M, and the other of the epaulets, e.g. epaulet 6a of FIG. 6A, upon the epaulet 6a being detached and upon the main member M being suitably folded as illustrated diagrammatically in FIGS. 9, 10 and 11 may be used to provide an over-the-shoulder carrying strap for the folded main member M as may be noted by reference to FIGS. 10 and 11.

Before describing in detail the structure of the preferred blanket-garment of the present invention, it will be understood that such description will utilize the terms top and bottom, front and rear, right and left, upwardly and downwardly and it will be still further understood that these terms are merely terms of reference and in the description provided in the following specification and in the recitations in the appended claims, such terms are with regard to the face of a person wearing the multi-purpose, reversible, blanket-garment of the present invention when converted into a poncho-type garment as illustrated in FIG. 3.

Figure 1A:
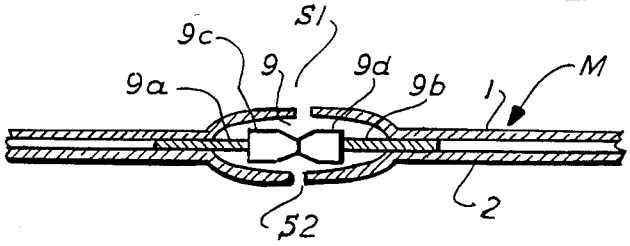
FIG. 1A is a partial sectional view taken generally along the lines A—A in FIG. 1 in the direction of the arrows.

Now with regard to the structure of the preferred embodiment of the multi-purpose, reversible, blanket-garment of the present invention, it will be understood by reference to FIGS. 1 and 1A that the main member M is of a size and configuration for use as an automobile robe, blanket and a poncho-type garment, and may include a top layer 1 of a suitable woven, wool, blanket-type material and a bottom layer 2 of water repellent material. The layers are of substantially the same generally rectangular size and configuration, overlie each other, and have their entire peripheral edges stitched together as indicated diagrammatically by the dashed line 7 in FIG. 1; the top layer 1 may be provided at its top and bottom ends with suitable decorative fringes as shown in FIG. 1. Further, as may be understood by reference to FIGS. 1 and 1A, and in particular to FIG. 1A, the top and bottom layers 1 and 2 are provided, respectively, generally centrally thereof with overlying slits S1 and S2, extending upwardly from the bottom thereof a length L1 approximately $\frac{2}{3}$ of the vertical length of the layers 1 and 2 of the main member M. The slits S1 and S2 of length L1 are provided, as shown in FIG. 1, with an upper portion P1, an intermediate portion P2, and a lower portion P3. For convenience of understanding, and before further proceeding with the detailed description of the present invention, it will be understood that a separating zipper is one which upon being unzipped the opposed rows of teeth may be separated with the zipper pull remaining engaged with only one of the rows of teeth, that a reversible zipper is one that has a zipper pull that flips to either side or has a zipper pull on either side thereof whereby the zipper may be zipped or unzipped from either side, and that a reversible and separating zipper is one which has the characteristics or features of both the separating and reversible zippers.

Sandwiched between the top and bottom layers 1 and 2, and residing centrally of the slits S1 and S2 (FIG. 1), is an upper separating and reversible zipper indicated by general reference numeral 10 and occupying the upper portion P1 of the slits, and a lower separating and reversible zipper indicated generally by reference numeral 9 and occupying the intermediate portion P2 of the slits S1 and S2; the bottom portion P3 of the slits S1 and S2 below the bottom of the intermediate zipper 10 remain separated but the portions of the layers 1 and 2 bordering this lower portion P3 of the slits S1 and S2 are stitched together as indicated by the stitching identified by reference numerals 8—8.

Figure 5:
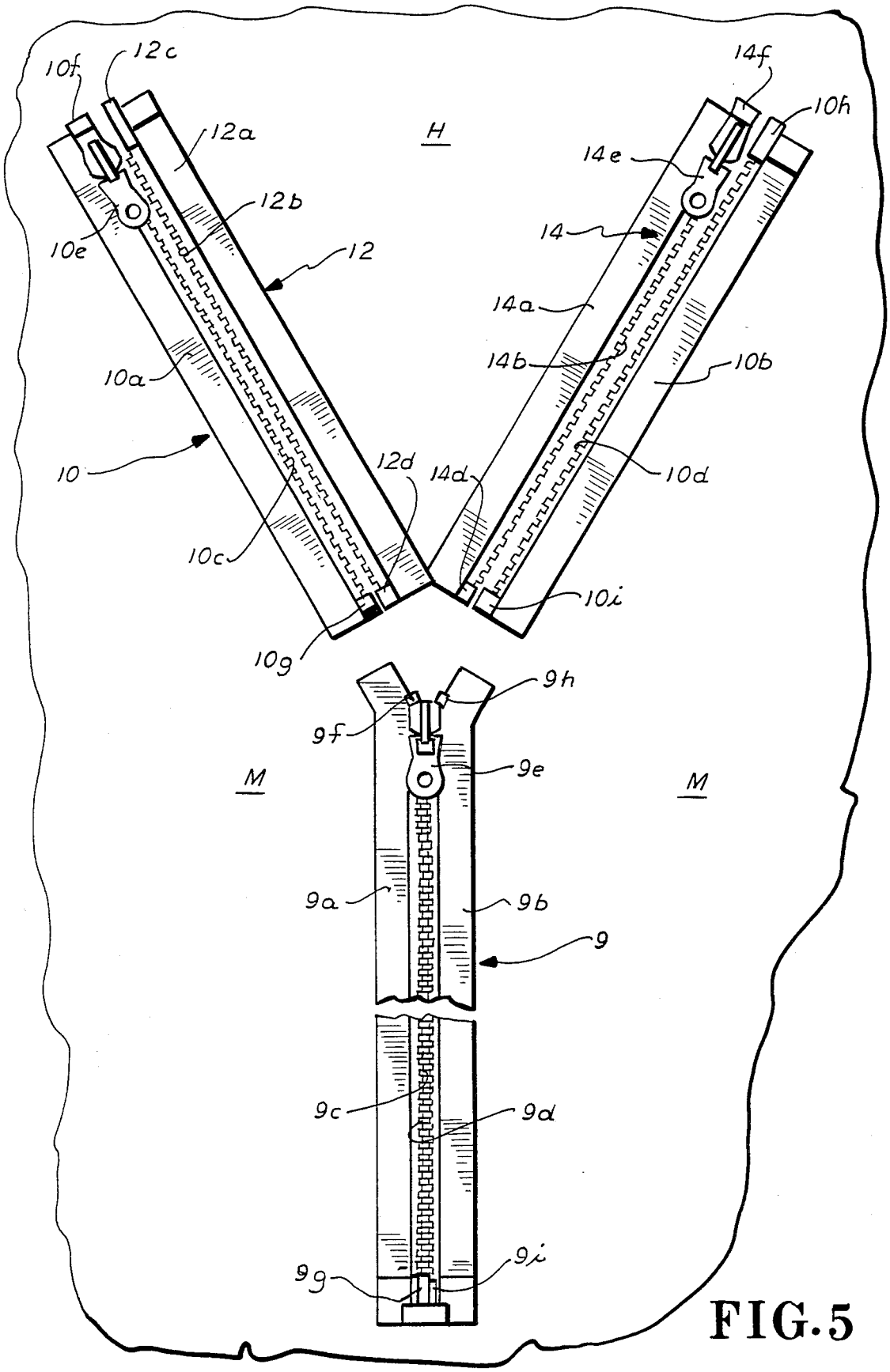
FIG. 5 is a diagrammatic illustration illustrating the mating relationship between the right and left zippers provided on the bottom portions of the hood and the right and left teeth of the upper zipper provided on the main member of the present invention.
Figure 5A:
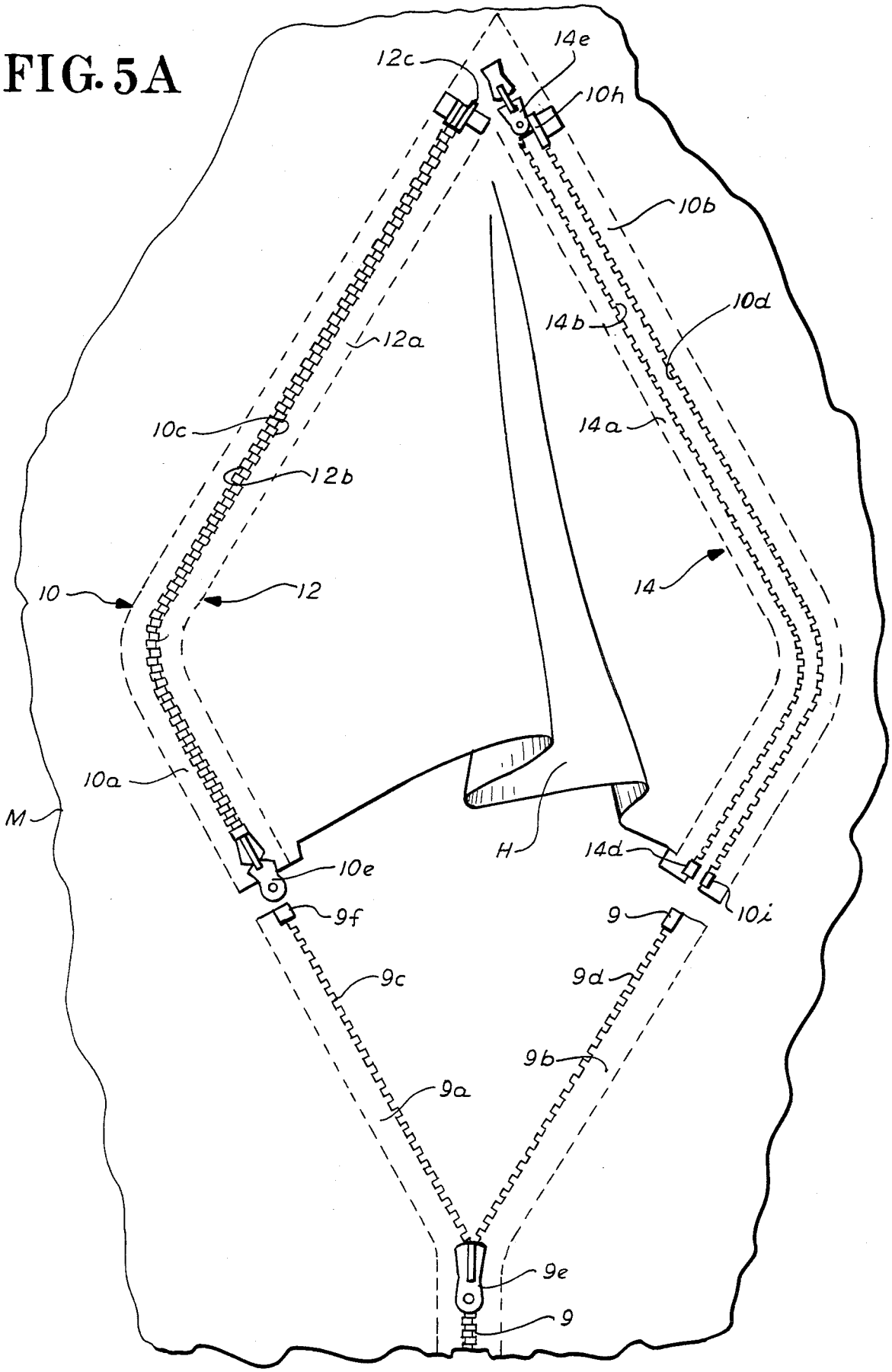
FIG. 5A is an illustration, similar to FIG. 5, but further illustrating the engagements of the mating zippers for fastening together the hood and main member of the present invention.

Referring again to the lower separating and reversible zipper 9 of the present invention and particularly to FIGS. 4, 5, and 5A (and recalling that the terms right and left are with reference to the face of the person wearing the poncho-type garment of the present invention as illustrated in FIG. 3), it will be understood that the lower separating and reversible zipper 9 includes opposed right and left tapes 9a and 9b, opposed right and left rows of zipper teeth 9c and 9d provided respectively on the right and left tapes 9a and 9b, lower zipper pull 9e which, in the embodiment of the present invention illustrated particularly in FIG. 5, is for unzipping the lower zipper 9 by being pulled downwardly and for zipping the lower zipper 9 by being pulled upwardly and which zipper pull 9e remains in engagement with the right row of teeth 9c upon the lower zipper 9 being unzipped and separated. The top end of the right row of teeth 9c is provided with a zipper stop 9f and the bottom end of the zipper teeth 9c is provided with a zipper stop 9g and the top end of the left zipper teeth 9d is provided with a zipper stop 9h and the bottom end of the left row of zipper teeth 9d is provided with a zipper lead 9i; it will be understood by those skilled in the art that the zipper pull 9e of the lower zipper 9 may reside on the left row of zipper teeth 9d with the respective zipper stops and leads at the top and bottoms of the right and left rows of teeth modified accordingly.

Referring again to upper zipper 10, and to FIGS. 4, 5 and 5A, it will be understood that the upper zipper 10 is a separating and reversible zipper and includes right and left tapes 10a and 10b, right and left rows of teeth 10c and 10d provided respectively on the right and left tapes 10a and 10b, and a zipper pull 10e for unzipping the zipper 10 upon being pulled upwardly and for zipping the zipper 10 on being pulled downwardly. In the embodiment shown in the FIGS., particularly FIG. 5, the upper zipper pull 10e resides on the right row of upper zipper teeth 10c upon the upper zipper 10 being unzipped and separated. The top end of the right row of teeth 10 is provided with a zipper stop 10f and the bottom end of the right row of zipper teeth 10d is provided with a zipper stop 10g; the left row of zipper teeth 10d is provided at its top end with zipper lead 10h and the bottom end of the left row of zipper teeth 10d is provided with a zipper stop 10i; it will be understood by those skilled in the art that the zipper pull 10 of the upper zipper may reside on the left row of zipper teeth 10 with the respective zipper stops and leads at the tops and bottoms of the right and left rows of teeth modified accordingly.

It will be understood, in accordance with the teachings of the present invention, that upon the upper and lower zippers 9 and 10 of the main member M of FIG. 1 being zipped closed, the main member may be readily used as a blanket, particularly a picnic blanket with the water repellent layer 2 facing the ground for moisture protection and with the woven, wool, blanket-type material of layer 1 facing upwardly; also, the main member M may be used as a blanket for tailgating, reversibly, with either the water repellent layer 2 facing downwardly and the blanket-type material of layer 1 extending upwardly, or reversed, to protect against beverage or other liquid spills. Additionally, the main member M may be used in numerous other blanket-type purposes where reversible wool and water repellent layers are desired. It will be noted that in such use the portions of the top and bottom layers 1 and 2 through which the elongated slots S1 and S2 are formed (FIG. 1B) substantially overlie the closed zippers 9 and 10 and prevent engagement with the zipper.

Figure 2A:
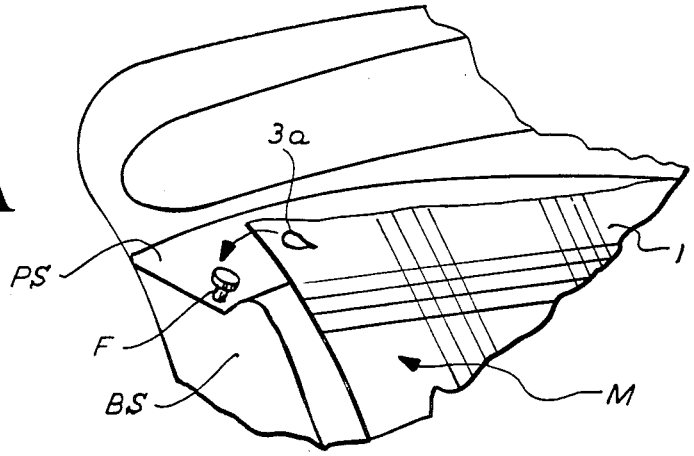
FIG. 2A is a partial perspective view illustrating, diagrammatically, the manner of securing the main member of the present invention to fastening means provided on the package shelf of an automobile back seat.

Referring now to FIGS. 2 and 2A, and first to FIG. 2, the use of the main member M as an automobile robe, or as a cover for the back seat of an automobile, will now be described. Referring to the corners of the main member M, it will be understood that the corresponding corner portions of the top and bottom layers 1 and 2 are provided with holes extending therethrough, the holes overlie each other, and the layers are stitched together around the holes. Such stitched holes are identified, respectively, as 3*a* . . . 3*d*. For use as the cover of the back seat of an automobile, the upper holes 3*a* and 3*b*, hole 3*a* being illustrated in FIG. 2A, receive upwardly extending automobile fastening means, such as the upwardly extended circularly headed fastening member F extending upwardly from the package shelf PS provided back of the back seat BS of an automobile, to secure the main member M to the automobile as a cover for the back seat of the automobile; alternatively, the main member M may be secured to the back seat BS of the automobile oriented horizontally by inserting the fastening members F through holes 3*a* and 3*c* or 3*b* and 3*d*. As illustrated in FIG. 2, the upper zipper 10 may be at least partially unzipped upwardly and the lower zipper 9 may be at least partially unzipped downwardly to provide an opening O through which the inner seat belts 15*a*–15*b* extend for respective engagement with outer seat belts 16*a* and 16*b* provided on the back seat. It will be understood that, due to the reversibility of the main member M, the main member M may be secured to the back seat of an automobile with the substantially waterproof layer 2 facing upwardly to protect the seat of the automobile from wet swimwear, sand, grit, etc., or the main member M may be secured to the back seat of an automobile with the woven, wool, blanket-type layer 1 facing upwardly to keep the automobile passengers or occupants warm.

The use of the multi-purpose, reversible, blanket-garment of the present invention, including the main member M (FIG. 1) and hood H (FIG. 4) as a poncho-type garment, and the manner of fastening the hood H to the main member M to form the poncho-type garment, will now be described. Referring first to FIG. 4, it will be understood that the hood H may include at least two layers of material which may be the same as layers 1 and 2 of the same materials as the main member M, and hence numerals 1 and 2 have been utilized in FIG. 4 to identify such layers of materials. As shown in FIG. 4, the layers 1 and 2 of the hood H are provided with right and left bottom portions, indicated generally and respectively as B1 and B2.

As may be understood by reference to FIGS. 4, 5 and 5A, a right hood half-zipper 12, of the same length as the upper zipper 10, is provided and includes a right zipper tape 12*a* and a right row of zipper teeth 12*b* provided on said right tape 12*a* with the top end of the right row of teeth 12*a* provided with a zipper lead 12*c* and with the bottom end thereof provided with a zipper stop 12*d*. The right hood half-zipper 12 resides between the right bottom portions B1 of the hood layers 1 and 2 with the right row of zipper teeth 12*b* extending downwardly and with the right bottom portions B1 of the hood layers 1 and 2 stitched together through the right tape 12*a* of the right hood half-zipper 12. As may be still further understood, a left hood half-zipper 14, of the same length as the upper zipper 10, is provided and includes a left zipper tape 14*a* and a left row of zipper teeth 14*b* provided on said left tape 14*a* with the top end of the left row of teeth 14*a* provided with a zipper stop 14*f* and with the bottom end thereof provided with a zipper stop 14*d*. The left hood half-zipper 14 resides between the left bottom portions B2 of the hood layers 1 and 2 with the left row of zipper teeth 14*b* extending downwardly and with the left portions B2 of the hood layers 1 and 2 stitched together through the left tape 14*a* of the left hood half-zipper 14. A hood zipper pull 14*e*, in the embodiment shown in FIG. 5, resides on the left row of teeth 14*b*; however, it will be understood by those skilled in the art that the hood zipper pull 14*e* may reside on the right row of hood zipper teeth 12*a* with the respective zipper stops and leads at the top and bottom ends of the right and left rows of hood zipper teeth modified accordingly. Still further, it will be understood by those skilled in the art, and as will be appreciated more fully below, upon the upper zipper pull 10*e* of the upper zipper 10 residing on the right row of upper zipper teeth 10*c*, the hood zipper pull 14*e* will reside on the left row of hood zipper teeth 14*b* and upon the upper zipper pull 10*e* residing on the left row of upper zipper teeth 10*d*, the hood zipper pull 14*e* will reside on the right row of hood zipper teeth 12*b*, that is the upper zipper pull 10*e* and the hood zipper pull 14*e* always reside on opposite rows of the right and left rows of upper zipper teeth and hood zipper teeth.

Referring now to FIGS. 4, 5 and 5A, and particularly to FIG. 5A, the fastening of the hood H to the main member M to form the poncho-type garment by fastening the hood H to the main member M by upper zipper 10 and hood half-zippers 12 and 14 will now be described. First, the upper zipper 10 will be unzipped from the bottom by pulling the upper zipper pull 10*e* upwardly the length of the upper zipper 10 to separate and expose the right and left upper zipper teeth 10*c* and 10*d* and to permit the head and neck of a person to project through the open and separated upper zipper 10 (FIG. 3). The hood H (FIG. 5A) is placed over the open and separated upper zipper 10 and, as may best be understood from FIGS. 5 and 5A, the upper zipper pull 10*e* of the upper zipper 10 is placed in engagement with the top zipper lead 12*c* of the right hood half-zipper 12 and the upper zipper pull 10*e* is pulled downwardly to zip the right zipper teeth 10*c* of the upper zipper 10 into engagement with the right teeth 12*b* of the right hood half-zipper 12 as is illustrated particularly in FIG. 5A. The zipper pull 14*e* of the left hood half-zipper 14 is then engaged with the top lead 10*h* of the left row of teeth 10*d* of the upper zipper 10 and the hood zipper pull 14*e* is pulled downwardly to zip the left hood zipper teeth 14*b* into engagement with the left zipper teeth 10*d* of the upper zipper 10. Thus, the hood H is zipped into engagement with the main member M as may be best seen in FIG. 4 and the poncho-type garment of the present invention is formed.

It further will be understood by those skilled in the art, and in accordance with the further teachings of the present invention, to facilitate donning of the poncho-type garment of the present invention by the wearer, the lower zipper 9 may be unzipped by pulling the lower zipper pull 9*e* downwardly to open and separate the right and left teeth 9*c* and 9*d* of the lower zipper 9 (it being recalled that the lower portion P3 of the slits S1 and S2 shown in FIG. 1 remain separated) whereby the poncho-type garment may be easily donned by the wearer in the same manner that an open coat is donned by the wearer.

Referring again to FIG. 4, it will be understood that upon the hood H being zipped into engagement with the main member M, the respective lower bottom portions B1 and B2 of the hood layers 1 and 2 form outer flaps 19 and inner flaps 20 for being folded over the engaged hood zippers 17 and 18 and the central zipper 9 to prevent engagement of the neck of the wearer of the poncho-type garment with the zippers.

Still further, and referring again to FIGS. 1 and 3, it will be understood that the layers of material 1 and 2 may be provided, as indicated diagrammatically at 4, with cooperating mating fastening means, such as button and buttonholes, for fastening the side edges of the main member M (FIG. 3) together to further enhance the poncho-garment effect.

As noted in FIG. 3, upon fastening of the hood H to the main member M to form the poncho-type garment of the present invention, the poncho-type garment may be worn with the woven, wool, blanket-type layer of material 1 extending outwardly and with a water repellent layer of material 2 residing inwardly or, in the event of rain, snow or other wet, inclement weather conditions, the layers may be reversed.

To enhance the appearance of the multi-purpose, reversible, blanket-garment of the present invention, particularly when converted into the poncho-type garment, epaulets 6*a* and 6*b* may be provided along the shoulder line formed in the main member upon the main member M being folded substantially in half in forming of the poncho-type garment illustrated in FIG. 3. The fastening of the epaulets 6*a* and 6*b* to the main member M may be best understood by reference to FIGS. 6*a* and 6A where it will be understood that the main member M, along the shoulder line, may be provided with fastening means 5 spaced along the shoulder lines for fastening engagement with correspondingly located fastening means 5*a* provided on the epaulets, such as epaulet 6*a* in FIG. 6A. It will be understood that the fastening means 5 and 5*a* may be, for example, buttons secured to the main member M along the shoulder line on the top and bottom thereof and the fastening means 5*a* provided on the epaulets may be corresponding buttonholes formed in the epaulets or vice versa. By such corresponding and mating fastening means, the epaulets 6*a* and 6*b* may be fastened to the main member M extending outwardly from the hood along the shoulder line, around the outer edges of the main member M, and back under the main member along the shoulder line. As may be understood by reference to FIG. 3, upon the epaulets being so fastened to the main member, items such as binoculars, camera, etc., may be secured to the poncho-type garment for ease and convenience of carrying.

Figures 6, 6A:
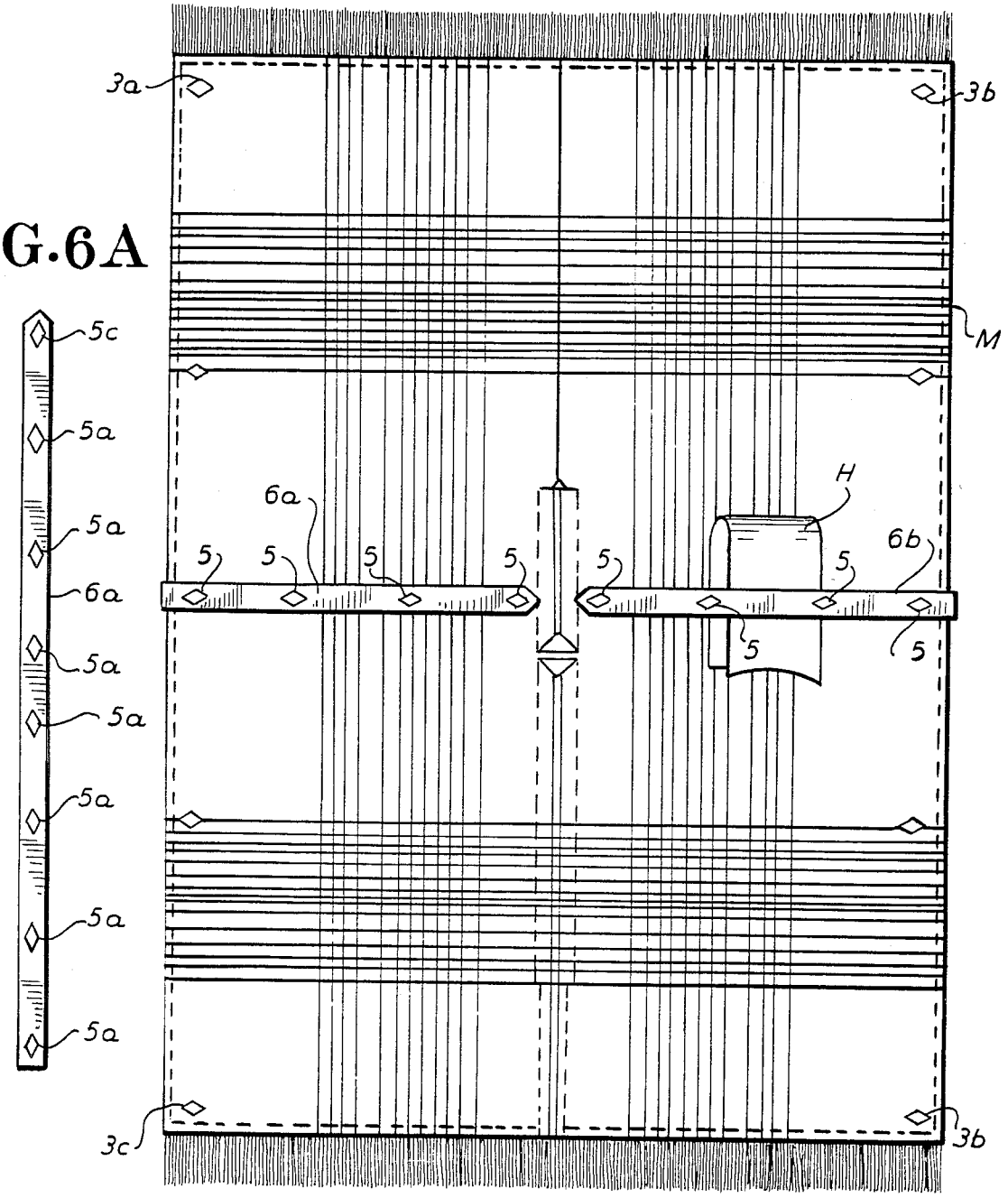
FIG. 6 is a top view of the main member of the present invention illustrating one epaulet attached to the main member for securing the hood of the present invention to the main member.
FIG. 6A is a top view of an epaulet or carrying strap of the present invention.
Figure 7:
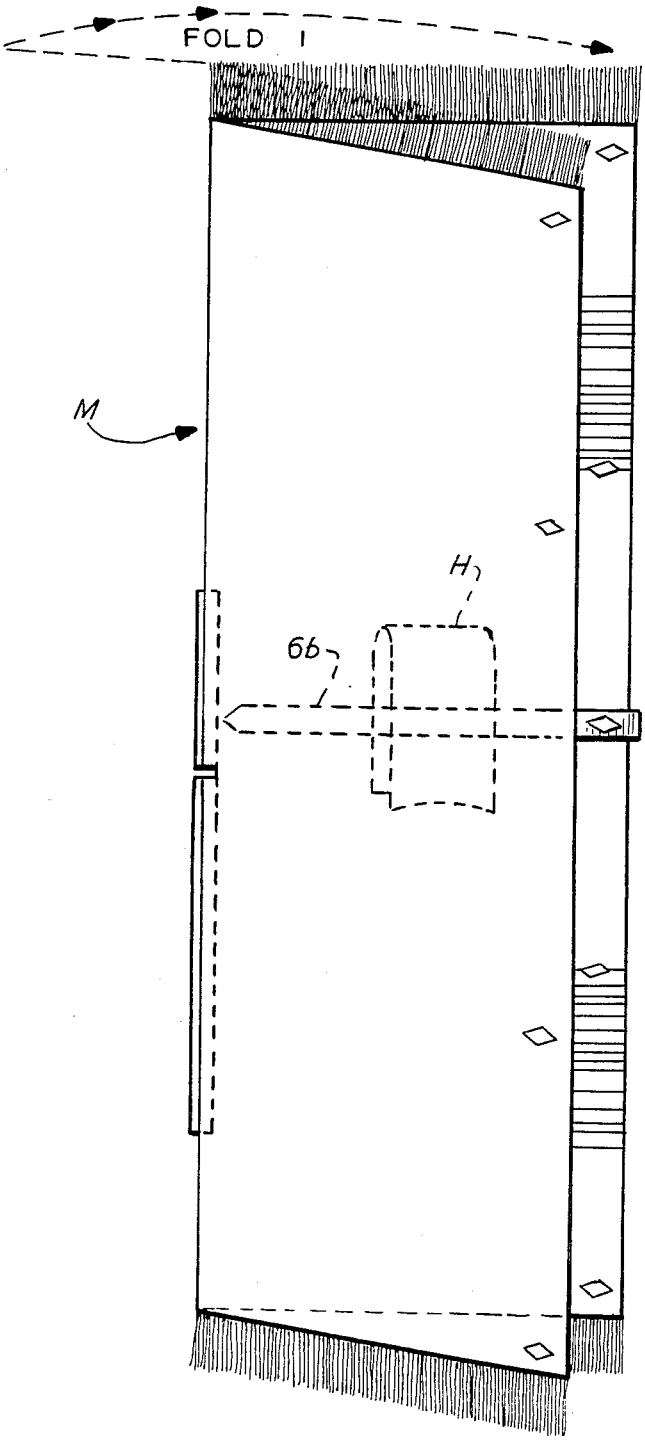
FIGS. 7 and 8 are diagrammatical illustrations showing the preferred manner of folding the main member of the present invention prior to being carried by one of the epaulets serving as an over-the-shoulder strap.
Figure 8:
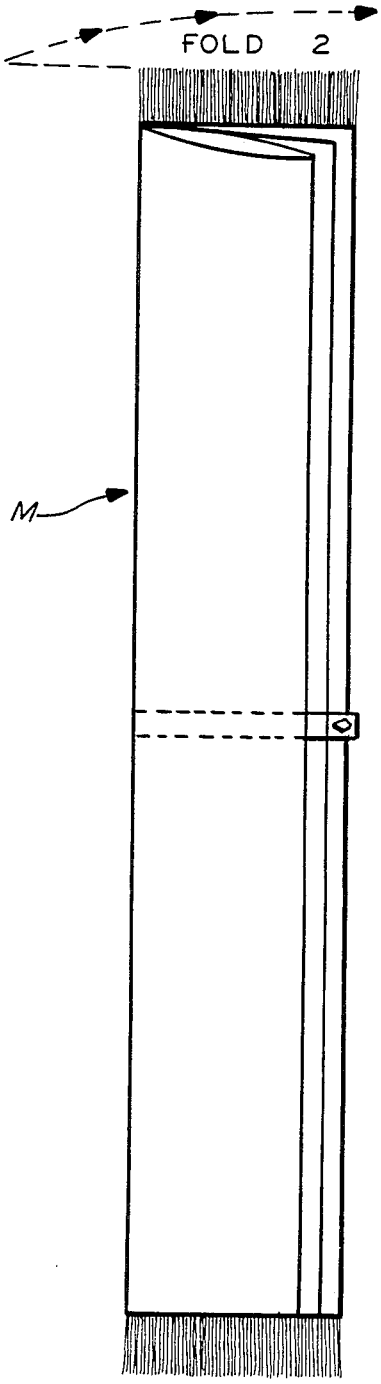

Referring again to FIG. 6, it will be understood that an epaulet, such as epaulet 6*b*, may be used to secure the hood H to the main member for convenience of association and carrying, and the other of the epaulets, e.g. epaulet 6*a* of FIG. 6, may be unfastened from the main member whereafter the main member M, FIGS. 7, 8 and 9, may be folded into a FOLD 1 as indicated by the arrows in FIG. 7, again folded into FOLD 2 as indicated by the arrows in FIG. 8, and thereafter folded, as indicated in FIG. 9, into a third FOLD 3 and over the epaulet 6*b*. As may be understood from FIG. 6A, epaulet 6*a* may be provided at its opposite ends with mating fastening means 5*a* and 5*c*, one being a button and the other a buttonhole or both being Velcro strips, whereafter the fastening means 5*a* and 5*c* of the epaulet 6*a* are fastened together to form the epaulet 6*a* into a shoulder carrying strap as illustrated in FIG. 10, whereafter the folded main member M is extended through the epaulet 6*a* and provided with a FOLD 4 to fold the main member M over the epaulet 6*a* now functioning as a shoulder carrying strap. The use of the epaulet 6*a* as a shoulder carrying strap for carrying the folded main member M by a person is illustrated diagrammatically in FIG. 11. In an alternate embodiment of the blanket-garment of the present invention, an additional epaulet of the same structure as epaulet 6*a* in FIG. 6A may be provided (allowing epaulets 6*a* and 6*b* to remain fastened to the main member M as illustrated in FIG. 6) and upon the main member M being folded as shown in FIGS. 10 and 11, the additional epaulet may be the carrying strap as illustrated in FIG. 11 with regard to epaulet 6*a*.

Still further, it will be understood that it is within the scope of the teachings of the present invention that a suitable bag may be provided for containing the entire multi-purpose, reversible, blanket-garment of the present invention.

It will be further understood by those skilled in the art that many variations and modifications of the present invention may be made without departing from the spirit and the scope thereof.

What is claimed is:

1. A multi-purpose, reversible, blanket-garment, comprising:

a generally rectangular main member of a size and configuration for use as an automobile robe, blanket and a poncho-type garment, said main member formed of at least two opposed layers, one layer being a layer of woven, wool blanket-type material and the other layer being a layer of water repellent material, said layers overlying each other and each layer having an elongated slit formed therein generally centrally thereof and extending upwardly a predetermined length from the bottom thereof, said slits having upper, central and lower portions, said slits overlying each other, and said layers having peripheral edges stitched together along their entire periphery;

a separating and reversible upper zipper including opposed right and left tapes, opposed right and left rows of zipper teeth provided respectively on said right and left tapes, an upper zipper pull residing on one of said right and left rows of teeth and for zipping and unzipping said upper zipper, said upper zipper residing centrally of said upper portion of said slits between said layers and said layers stitched together through said tapes;

a separating and reversible lower zipper including opposed right and left tapes, opposed right and left rows of zipper teeth provided respectively on said right and left tapes, a lower zipper pull residing on one of said right and left rows of teeth and for zipping and unzipping said lower zipper, said lower zipper residing centrally of said intermediate portion of said slits between said layers and said layers stitched together through said tapes;

said layers stitched together on either side of said lower portion of said slits and said stitching of said peripheral edges and said stitching through said tapes enclosing an insulating air space between said layers;

a hood formed of at least two layers of the same two layers of materials as said main member, said layers of said hood provided with right and left bottom portions;

a right hood half-zipper including a right tape and a right row of zipper teeth provided on said right tape, a left hood half-zipper including a left tape and a left row of zipper teeth provided on said left tape, and a hood zipper pull residing on one of said right and left rows of hood zipper teeth opposite to the right and left row of upper zipper teeth on which said upper zipper pull resides;

said right and left hood half-zippers residing respectively between said right and left bottom portions of said hood layers with said right and left rows of hood zipper teeth extending downwardly and said right and left bottom portions of said hood layer stitched together respectively through said right and left tapes of said right and left hood half-zippers;

upon said upper zipper being unzipped to permit the head and neck of a person to project therethrough, said upper zipper pull for zipping the upper zipper row of teeth on which said upper zipper resides into engagement with one of said right and left rows of hood-zipper teeth and said hood zipper pull for zipping the row of hood zipper teeth on which said hood zipper pull resides into engagement with the other of said right and left rows of teeth of said upper zipper to removably fasten said hood to said main member.

2. A multi-purpose, reversible, blanket-garmet according to claim 1 wherein said right and left bottom portions of said layers of said hood extend downardly over and cover said right and left hood zippers and provide flaps for covering said zippers upon said hood being zipped into engagement with said main member, said flaps for preventing engagement between a person's neck and said zippers.

3. A multi-purpose, reversible, blanket-garment according to claim 2 wherein said blanket-garmet further comprises a pair of generally longitudinally extending epaulets, each epaulet formed of at least two layers of the same two layers of materials as said main member, and wherein upon said hood being fastened to said main member, and upon said main member being folded in half to form a poncho-type garmet, said main member having shoulder lines extending generally outwardly from said hood and said epaulets and said main member provided with mating epaulet fastening means for fastening said epaulets to said main member with said epaulets extending outwardly from said hood along said shoulder line, around the outer edges of said garment and back again under said main member along said shoulder line, and upon said epaulets being fastened to said main members said epaulets for securing items to said main member such as binoculars and camera.

4. A multi-purpose, reversible, blanket-garment according to claim 3 wherein at least one of said epaulets is provided with mating fastening means at the opposite ends thereof, and wherein upon said at least one epaulet being unfastened from said main member and upon said main member being folded on itself into a generally longitudinally extending shape and upon the opposite ends of said at least one epaulet being fastened together, said at least one epaulet for providing a shoulder carrying strap with said folded main member extending therethrough and folded thereover.

5. A multi-purpose, reversible, blanket-garment according to claim 1 wherein said layers of said main member have corresponding corner portions provided with holes extending therethrough, said holes overlying each other and said layers stitched together around said holes, said holes, upon said hood being unfastened from said main member, for receiving outwardly extending automobile fastening means provided on the package shelf of the back seat of an automobile to secure said main member to said automobile and facilitate use of said main member as a cover for the back seat of said automobile, said upper zipper for being unzipped upwardly to provide an opening to permit inner seat belts provided on said back seat to extend therethrough for engagement with outer seat belts provided on said back seat.

6. A multi-purpose, reversible, blanket-garment according to claim 3 wherein said blanket-garment includes an additional epaulet provided with mating fastening means on the opposite ends thereof, and wherein upon said main member being folded as said in claim 4, said additional epaulet for providing a shoulder carrying strap with said folded main member extending therethrough and folded thereover.

* * * * *